US011047172B2

(12) United States Patent
Huang

(10) Patent No.: US 11,047,172 B2
(45) Date of Patent: Jun. 29, 2021

(54) CORD-RESISTANCE ADJUSTING DEVICE

(71) Applicant: TAICANG KINGFU PLASTIC MANUFACTURE CO., LTD., Taicang (CN)

(72) Inventor: Szu-Chang Huang, Fusing Township, Changhua County (TW)

(73) Assignee: TAICANG KINGFU PLASTIC MANUFACTURE CO., LTD., Taicang (CN)

( * ) Notice: Subject to any disclaimer, the term of this patent is extended or adjusted under 35 U.S.C. 154(b) by 19 days.

(21) Appl. No.: 16/788,112

(22) Filed: Feb. 11, 2020

(65) Prior Publication Data

US 2021/0131175 A1 May 6, 2021

(30) Foreign Application Priority Data

Oct. 30, 2019 (CN) ..... 201921849211.7

(51) Int. Cl.
*E06B 9/322* (2006.01)

(52) U.S. Cl.
CPC ..... *E06B 9/322* (2013.01); *E06B 2009/3222* (2013.01)

(58) Field of Classification Search
CPC .. E06B 9/322; E06B 9/324; E06B 2009/3222; E06B 2009/3225
See application file for complete search history.

(56) References Cited

U.S. PATENT DOCUMENTS

| | | | | |
|---|---|---|---|---|
| 9,127,500 | B2 * | 9/2015 | Huang | E06B 9/322 |
| 9,587,428 | B2 * | 3/2017 | Huang | E06B 9/323 |
| 9,874,057 | B2 * | 1/2018 | Huang | E06B 9/322 |
| 10,151,140 | B2 * | 12/2018 | Chen | F16D 41/12 |
| 10,273,748 | B2 * | 4/2019 | Chen | E06B 9/322 |
| 10,480,244 | B2 * | 11/2019 | Chen | E06B 9/78 |
| 10,550,635 | B2 * | 2/2020 | Lin | E06B 9/305 |
| 10,704,323 | B2 * | 7/2020 | Chen | E06B 9/322 |
| 10,704,658 | B2 * | 7/2020 | Chen | E06B 9/322 |
| 10,774,582 | B2 * | 9/2020 | Chen | F16H 19/0672 |
| 2007/0102125 | A1 * | 5/2007 | Nien | E06B 9/324 160/178.2 |
| 2012/0280072 | A1 * | 11/2012 | Lin | E06B 9/262 242/157 R |
| 2015/0275572 | A1 * | 10/2015 | Huang | E06B 9/38 160/173 R |
| 2015/0275573 | A1 * | 10/2015 | Huang | E06B 9/38 160/192 |
| 2016/0298385 | A1 * | 10/2016 | Chen | E06B 9/324 |
| 2018/0119490 | A1 * | 5/2018 | Chen | E06B 9/42 |
| 2018/0171706 | A1 * | 6/2018 | Yamagishi | E06B 9/324 |
| 2018/0291678 | A1 * | 10/2018 | Zheng | E06B 9/322 |

(Continued)

*Primary Examiner* — Johnnie A. Shablack
(74) *Attorney, Agent, or Firm* — Hamre, Schumann, Mueller & Larson, P.C.

(57) ABSTRACT

A cord-resistance adjusting device for a venetian blind includes limiting blocks disposed in a casing unit containing a scroll spring and cord reels. Each of two side casing parts of the casing unit has inner and outer limiting columns mounted thereinside. Each limiting block is movably disposed in the respective side casing part between the inner and outer limiting columns. A lift cord bends around and frictionally contacts the respective limiting block when moving from the inner limiting column to the outer limiting column.

9 Claims, 10 Drawing Sheets

(56) References Cited

U.S. PATENT DOCUMENTS

| | | | | |
|---|---|---|---|---|
| 2018/0291679 | A1* | 10/2018 | Zheng | E06B 9/323 |
| 2019/0063147 | A1* | 2/2019 | Cheng | E06B 9/322 |
| 2019/0323288 | A1* | 10/2019 | Chen | E06B 9/322 |
| 2019/0323289 | A1* | 10/2019 | Chen | B65H 75/486 |
| 2019/0323291 | A1* | 10/2019 | Chen | E06B 9/364 |

* cited by examiner

CORD-RESISTANCE ADJUSTING DEVICE

CROSS-REFERENCE TO RELATED APPLICATION

This application claims priority of Chinese Utility Model Patent Application No. 201921849211.7, filed on Oct. 30, 2019.

FIELD

The disclosure relates to cord-resistance adjusting device, more particularly to a cord-resistance adjusting device for installing on a venetian blind.

BACKGROUND

FIG. 1 shows a conventional blind driving device 8 adapted for installing on a venetian blind (not shown) with hidden cords. The venetian blind includes an upper beam, a lower beam opposite to the upper beam, a plurality of slats disposed between the upper and lower beams, and two lift cords interconnecting the slats. The conventional blind driving device 8 includes a casing 81, a spring driving mechanism 82 disposed on the casing 81, and two cord reels 83 rotatably mounted to the casing 81. The casing 81 has two casing bodies 811 connected to each other. The spring driving mechanism 82 includes a spool set 821 and a scroll spring 822. The spool set 821 has a drive spool 823 and a take-up spool 824 each rotatably mounted to the casing 81. The drive spool 823 and the take-up spool 824 are meshingly connected to each other through their gear portions 823*a*, 824*a*. The scroll spring 822 is connected between the drive spool 823 and the take-up spool 824. One end of the scroll spring 822 is mounted to the drive spool 823 and the other end of the scroll spring 822 is sleeved around the take-up spool 824. The scroll spring 822 is mainly wound around the take-up spool 824 when no forces are applied thereto. The lift cords are respectively wound around the cord reels 83, and extend through the slats to connect with the lower beam. One of the cord reels 83 is meshingly connected with the drive spool 823, the other one of the cord reels 83 is meshingly connected with the take-up spool 824.

When a user wishes to expand the venetian blind, they may use both hands to pull the lower beam downward so as to pull the lift cords from the cord reels 83. The cord reels 83 drive the take-up spool 824 and the drive spool 823 to rotate such that the scroll spring 822 winds around the drive spool 823. When the user releases the lower beam, a restoring force of the scroll spring 822 balances the weight of the lower beam and the slats such that the lower beam may be kept at any desirable height.

When the user wishes to retract the venetian blind, they may use both hands to push the lower beam upward so that restoring force of the scroll spring 822 drives the drive spool 823 to rotate and causes the scroll spring 822 to re-wind around the take-up spool 824. In turn, rotation of the drive spool 823 drives the cord reels 83 to rotate and re-wind the lift cords.

However, as the venetian blind needs to be fitted according to window size in practical use and therefore may have a range of size and weight, the conventional blind driving device 8 must also be provided with the scroll spring 822 having different restoring forces. This is inconvenient, and also makes the conventional blind driving device 8 difficult to standardize and mass produce.

SUMMARY

Therefore, the object of the disclosure is to provide a cord-resistance adjusting device that can alleviate the drawback of the prior art.

According to the disclosure, a cord-resistance adjusting device is adapted for installing on a venetian blind which includes two lift cords. The cord-resistance adjusting device includes a casing unit, a spring driving unit, two cord reels and at least one limiting block.

The casing unit is adapted for mounting to the venetian blind and includes an upper casing part, a lower casing part opposite to the upper casing part in a first direction, and two side casing parts spaced-apart in a second direction which is transverse to the first direction and cooperating with the upper and lower casing parts to define a receiving space.

Each of the side casing parts includes a side casing part body, a first cord-exit hole extending through the side casing part body in the second direction and in spatial communication with the receiving space, and a limiting column set mounted to the side casing body inside the first cord-exit hole.

The spring driving unit is disposed in the receiving space.

The cord reels are rotatably disposed in the receiving space, and respectively and meshingly connected with two opposite sides of the spring driving unit.

The at least one limiting block is disposed in at least one of the side casing parts.

Each of the limiting column sets of the side casing parts includes an inner limiting column proximal to a respective one of the cord reels, and an outer limiting column distal to the respective one of the cord reels. The inner and outer limiting columns are adapted for a respective one of the lift cords to bend therearound in a frictionally contacting manner.

For the at least one of the side casing parts, the at least one limiting block is movably disposed in the first cord-exit hole between the inner and outer limiting columns such that the first cord-exit hole is provided with a cord-exit path consecutively passing through the inner limiting column, the at least one limiting block and the outer limiting column, whereby the respective lift cord frictionally contacts the at least one limiting block when moving from the inner limiting column to the outer limiting column along the cord-exit path.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
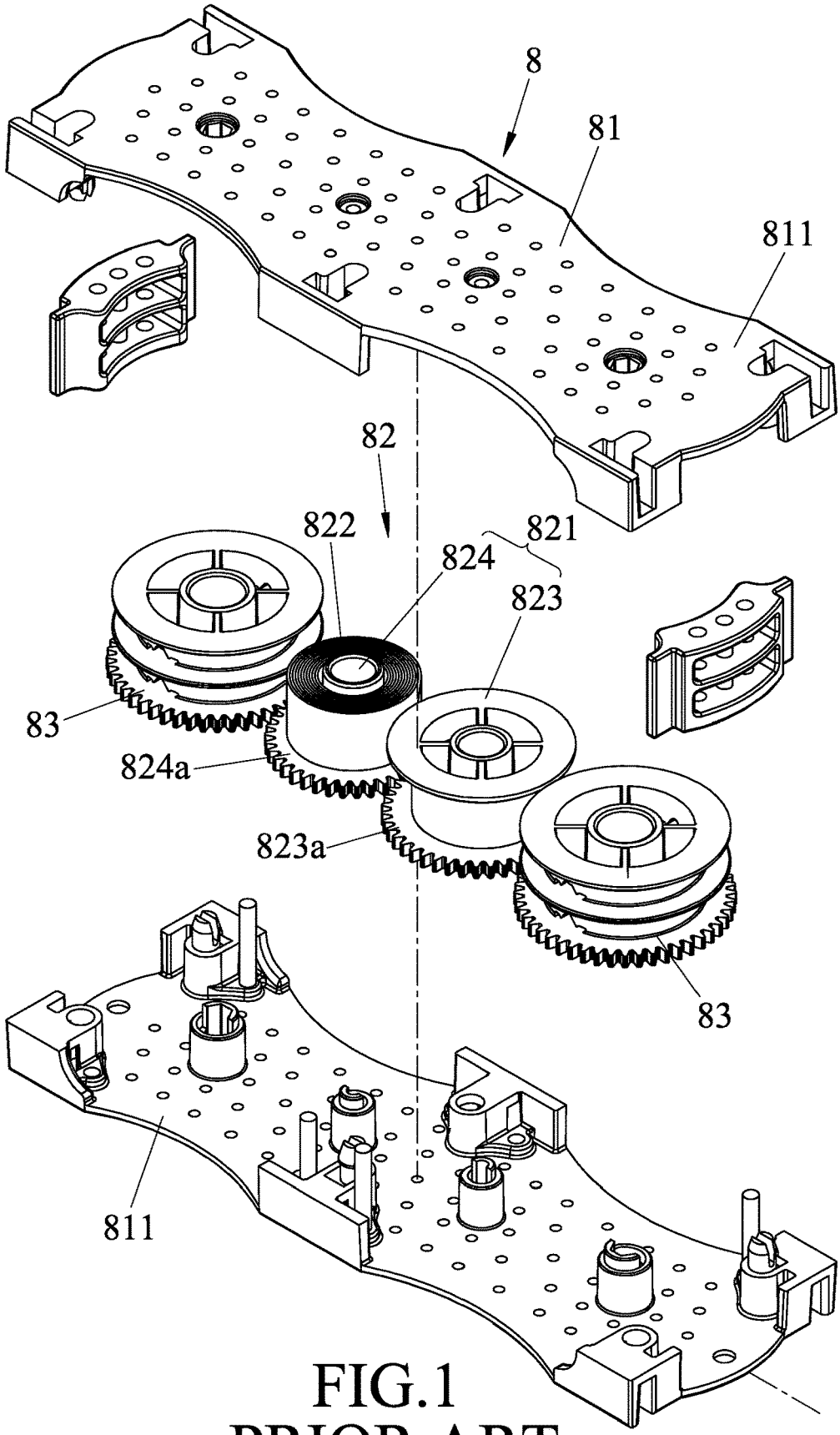
FIG.1 PRIOR ART
FIG. 1 is an exploded perspective view of a conventional blind driving device.
Figure 2:
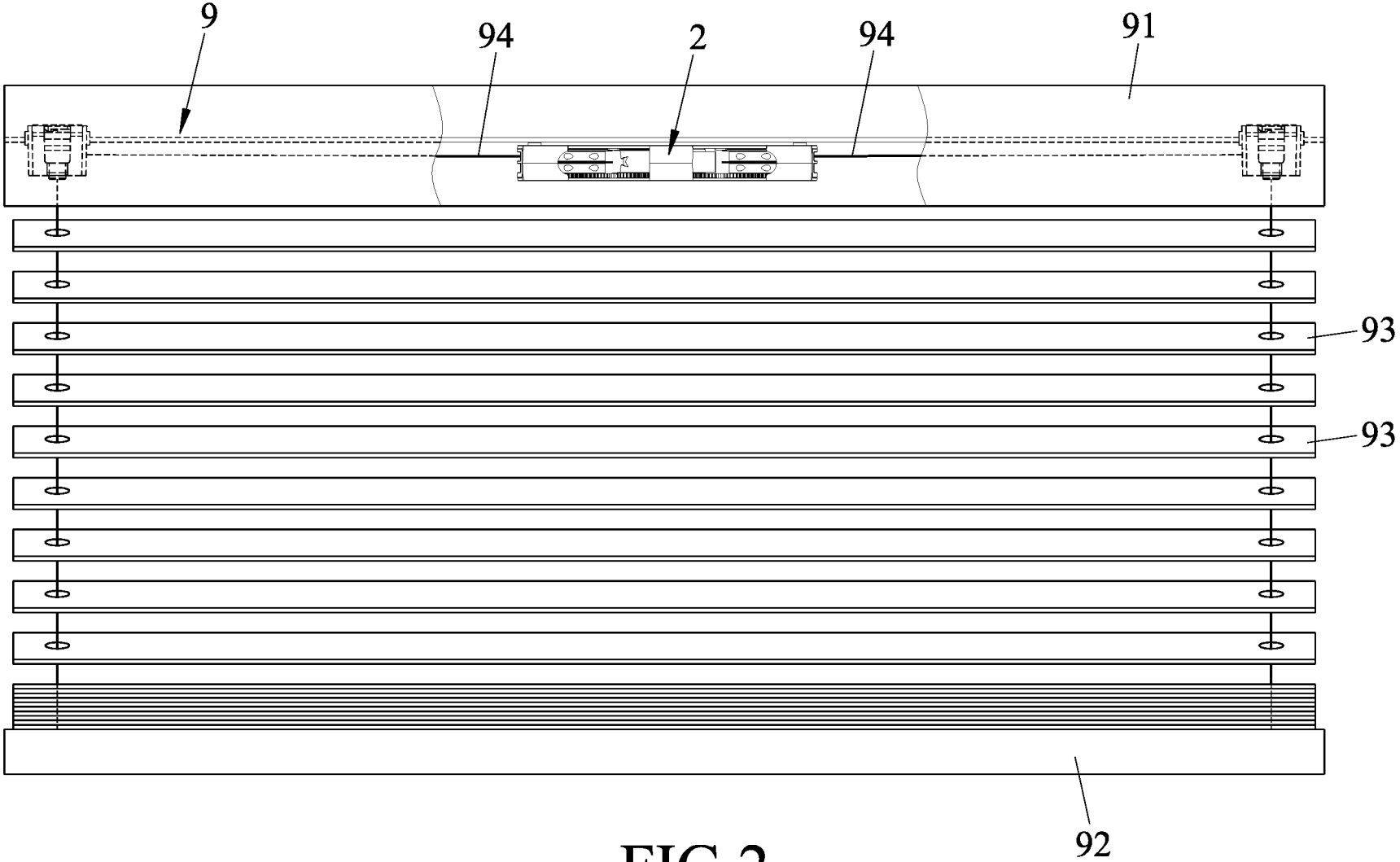
FIG. 2 is a side view of an embodiment of a cord-resistance adjusting device according to the disclosure adapted for installing on a venetian blind.
Figure 3:
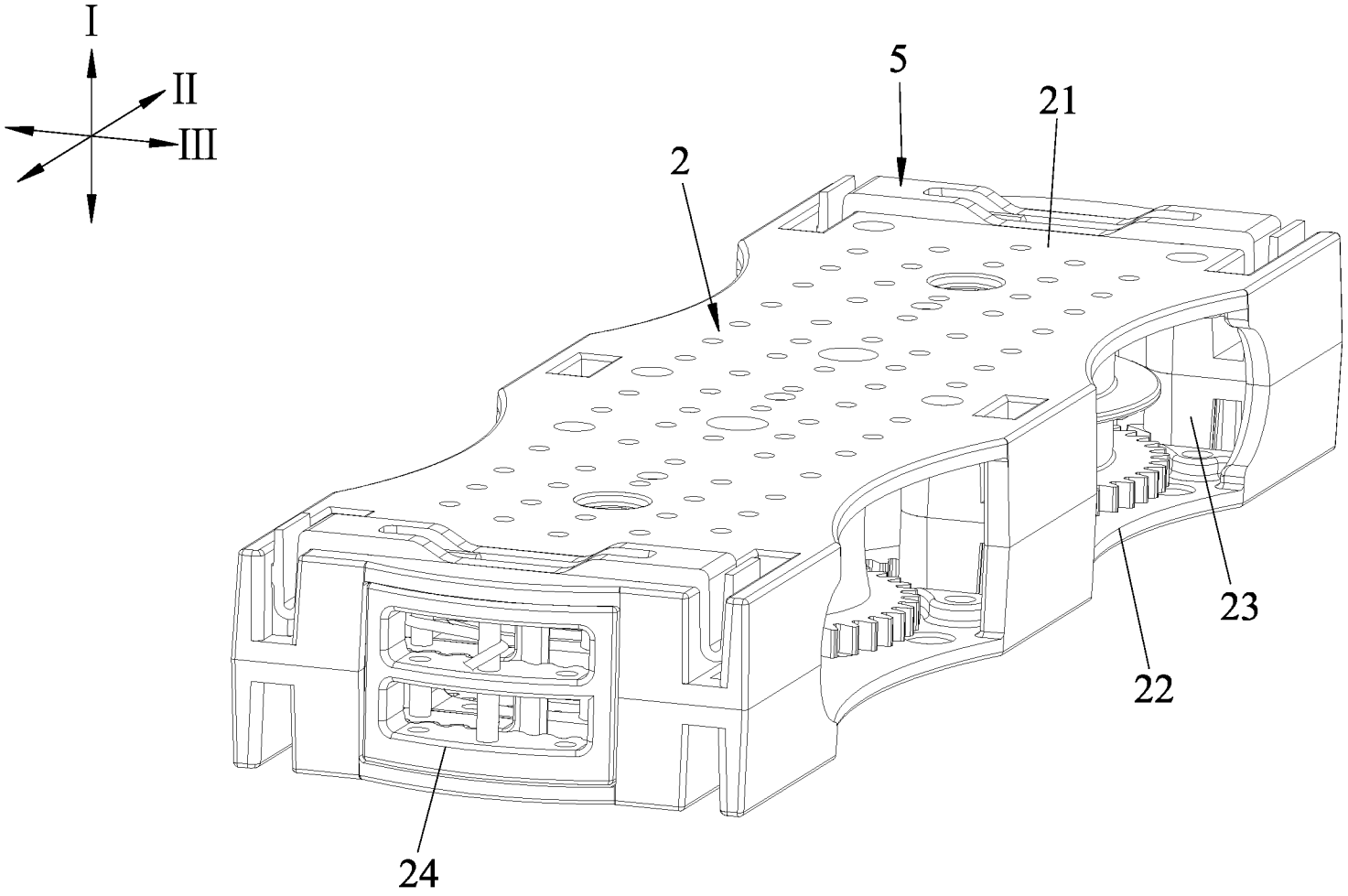
FIG. 3 is a perspective view of the embodiment.
Figure 4:
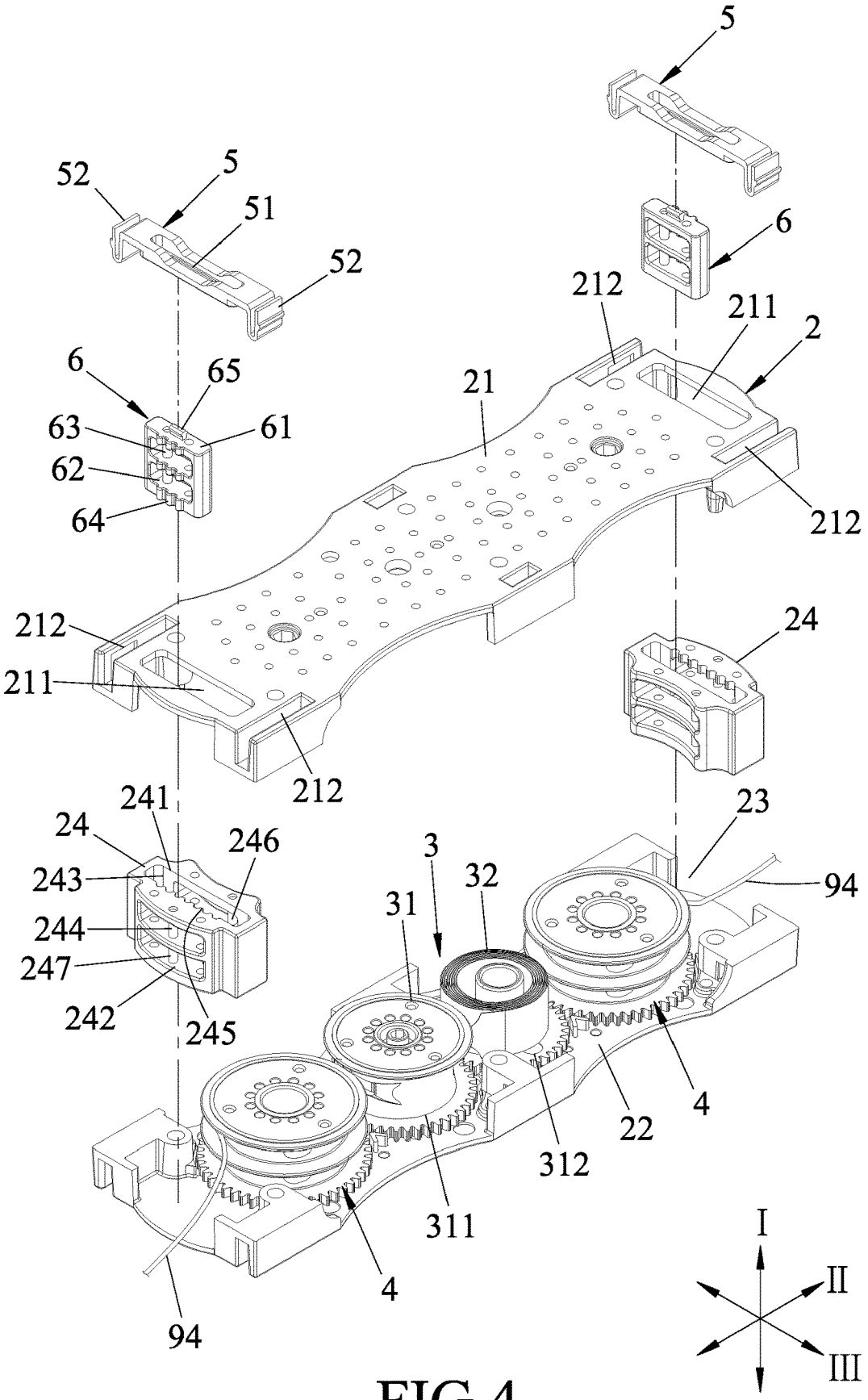
FIG. 4 is a partly exploded perspective view of the embodiment.

Referring to FIGS. 2 to 4, an embodiment of a cord-resistance adjusting device is adapted for installing on a venetian blind 9. The venetian blind 9 includes an upper beam 91, an lower beam 92 opposite to the upper beam 91, a plurality of slats 93 disposed between the upper and lower beams 91, 92, and two lift cords 94 interconnecting the slats 93. The cord-resistance adjusting device includes a casing unit 2, a spring driving unit 3, two cord reels 4, two fixing frames 5 and two limiting blocks 6.

The casing unit 2 is adapted for mounting to the venetian blind 9 and includes an upper casing part 21, a lower casing part 22 opposite to the upper casing part 22 in a first direction (I), and two side casing parts 24 spaced-apart in a second direction (II) which is transverse to the first direction (I) and cooperating with the upper and lower casing parts 21, 22 to define a receiving space 23.

The upper casing part 21 has two upper limiting slots 211 opposite to each other in the second direction (II) and disposed corresponding to the side casing parts 24, and two pairs of upper engaging grooves 212. Each of the pairs of upper engaging grooves 212 are respectively disposed on two opposite sides of a respective one of the upper limiting slots 211 along a third direction (III) which is transverse to both the first and second directions (I, II).

Each of the side casing parts 24 includes a side casing part body 241, a first cord-exit hole 242 that extends through the side casing part body 241 in the second direction (II) and that is in spatial communication with the receiving space 23 to be adapted for a respective lift cord 94 to extend therethrough, a side limiting slot 243 extending in the first direction (I) through the side casing part body 241 in spatial communication with the first cord-exit hole 242, a limiting column set 244 that is mounted to the side casing body 241 inside the first cord-exit hole 242, and a casing teeth portion 245 (see FIG. 5) that protrudes into the side limiting slot 243 from a side thereof which is distal from the respective cord reel 4. The limiting column set 244 of each side casing part 24 includes an inner limiting column 246 proximal to the respective cord reel 4, and an outer limiting column 247 distal to the respective cord reel 4 (best shown in FIGS. 5, 6). The inner and outer limiting columns 246, 247 are adapted for the respective lift cord 94 to bend therearound in a frictionally contacting manner. Each side limiting slot 243 is disposed between the inner and outer limiting columns 246, 247. The upper limiting slots 211 of the upper casing 21 respectively correspond in position with the side limiting slots 243.

The spring driving unit 3 is disposed in the receiving space 23 and includes a spool set 31 and a scroll spring 32. The spool set 31 has a drive spool 311 and a take-up spool 312 meshingly connected to each other and each rotatably mounted to the lower casing 22. One end of the scroll spring 32 is mounted to the drive spool 311 and the other end is sleeved around the take-up spool 312. When no forces are applied to the scroll spring 32, the scroll spring 32 is in a relaxed state and is mainly wound around the take-up spool 312.

The cord reels 4 are rotatably disposed in the receiving space 23 on two opposite sides of the spring driving unit 3, and are meshingly connected with the spring driving unit 3. The cord reels 4 are adapted for the lift cords 94 to wind therearound and connect thereto, respectively.

The fixing frames 5 are mounted to the upper casing part 21 and may be removed by taking it outward in the first direction (I). Specifically, each fixing frame 5 partially and engagingly extends into the respective upper limiting slot 211 and the respective side limiting slot 243 of a respective side casing part 24. Each fixing frame 5 includes a sliding slot 51 that extends in the third direction (III), and two engaging portions 52 that are disposed on opposite sides of the sliding slot 51 and that respectively engage two of the upper engaging grooves 212 proximal to the respective upper limiting slots 211.

The limiting blocks 6 are respectively coupled with the fixing frames 5. Specifically, the limiting blocks 6 are partially and slidably inserted into the sliding slots 51 of the fixing frames 5, respectively (see FIGS. 7, 8). Each limiting block 6 has an engaging element 65 slidably engaging the respective sliding slot 51. The limiting blocks 6 are also respectively and removably inserted into the side limiting slots 243 of the side casing parts 24 in the first direction (I). Each limiting block 6 has a block body 61, a second cord-exit hole 62 that extends in the second direction (II) through the block body 61 and in communication with the first cord-exit hole 242 for the respective lift cord 94 to exit therethrough, a limiting block column 63 disposed in the second cord-exit hole 62 along the first direction (I) for the respective lift cord 94 to bend therearound in a frictionally contacting manner, and a block teeth portion 64 formed on a side of the block body 61 which is distal to a corresponding one of the cord reels 4. The block teeth portions 64 of the limiting blocks 6 mesh with the casing teeth portions 245 of the side casing parts 24, respectively. Each of the casing teeth portions 245 have more teeth than one of the block teeth portions 64 such that each block teeth portion 64 can mesh with the respective casing teeth portion 245 at different selected sections of the respective casing teeth portion 245 for adjustment of the position of each block teeth portion 64 relative to the respective casing teeth portion 245.

For each of the side casing parts 24, a respective one of the limiting blocks 6 is movably disposed in the first cord-exit hole 242 between the inner and outer limiting columns 246, 247 such that the first cord-exit hole 242 is provided with a cord-exit path (see P in FIG. 5) consecutively passing through the inner limiting column 246, the limiting block 6 and the outer limiting column 247, whereby the respective lift cord 94 frictionally contacts the limiting block 6 when moving from the inner limiting column 246 to the outer limiting column 247 along the cord-exit path.

To install the cord-resistance adjusting device onto the venetian blind 9, first each of the lift cords 94 is wound around the respective cord reel 4, bended sequentially around the respective inner limiting column 246, limiting block column 63, and outer limiting column 247, and is caused to exit through the respective first cord-exit hole 242.

When a user wishes to expand the venetian blind 9, they may use both hands to pull the lower beam 92 downward so as to pull the lift cords 94 respectively from the cord reels 4. The cord reels 4 respectively drive the take-up spool 312 and the drive spool 311 to rotate such that the scroll spring 32 is unwound from the take-up spool 312 and wound around the drive spool 311.

When the user releases the lower beam 92 at a desired height, the weight of the lower beam 92 and the slats 93 is balanced by the restoring force of the scroll spring 32 so that the lower beam 92 is kept at the desired height. This mechanism is conventional in the arts, details of which is omitted for the sake of brevity.

When the user wishes to retract the venetian blind 9, they may use both hands to push the lower beam 92 upward, so that the restoring force of the scroll spring 32 drives the drive spool 311 to rotate and causes the scroll spring 32 to re-wind around the take-up spool 312. Rotation of the drive spool 311 in turn drives each of the cord reels 4 to rotate and re-wind the respective lift cord 94.

Figure 5:
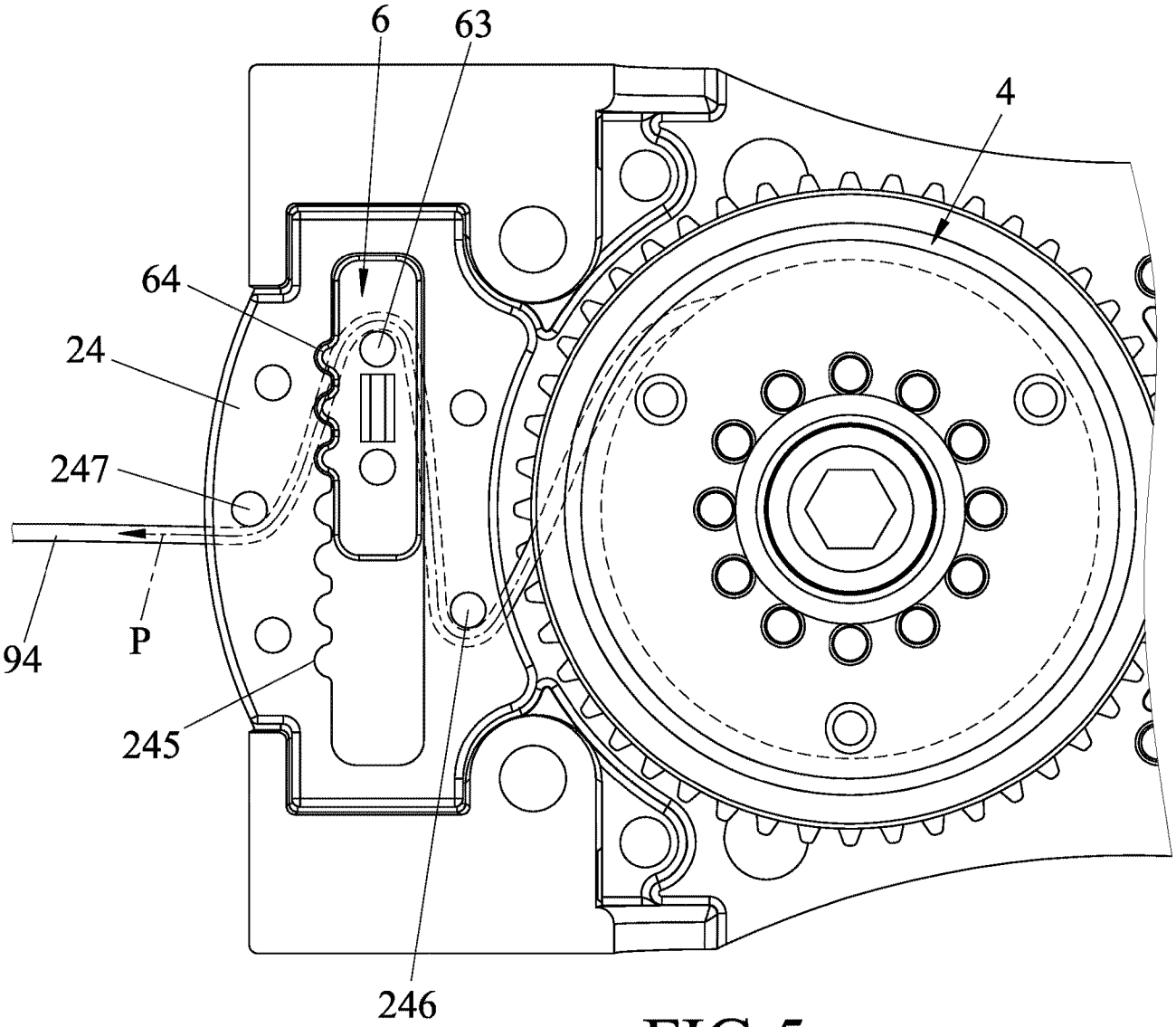
FIG. 5 is a fragmentary top view of the embodiment illustrating a limiting block of the embodiment at a position of maximum resisting force.
Figure 6:
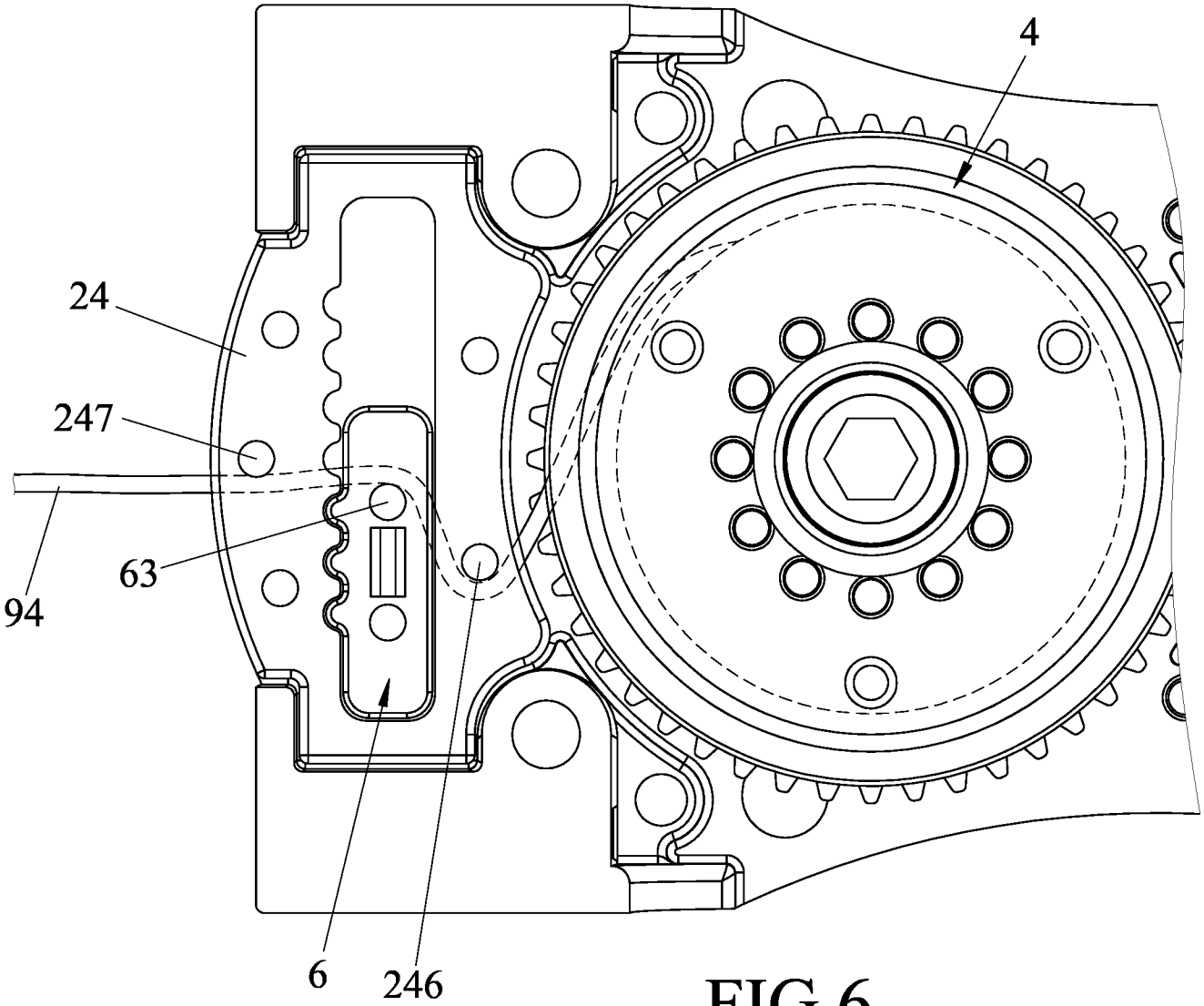
FIG. 6 is a fragmentary top view of the embodiment illustrating a limiting block of the embodiment at a position of minimum resisting force.
Figure 7:
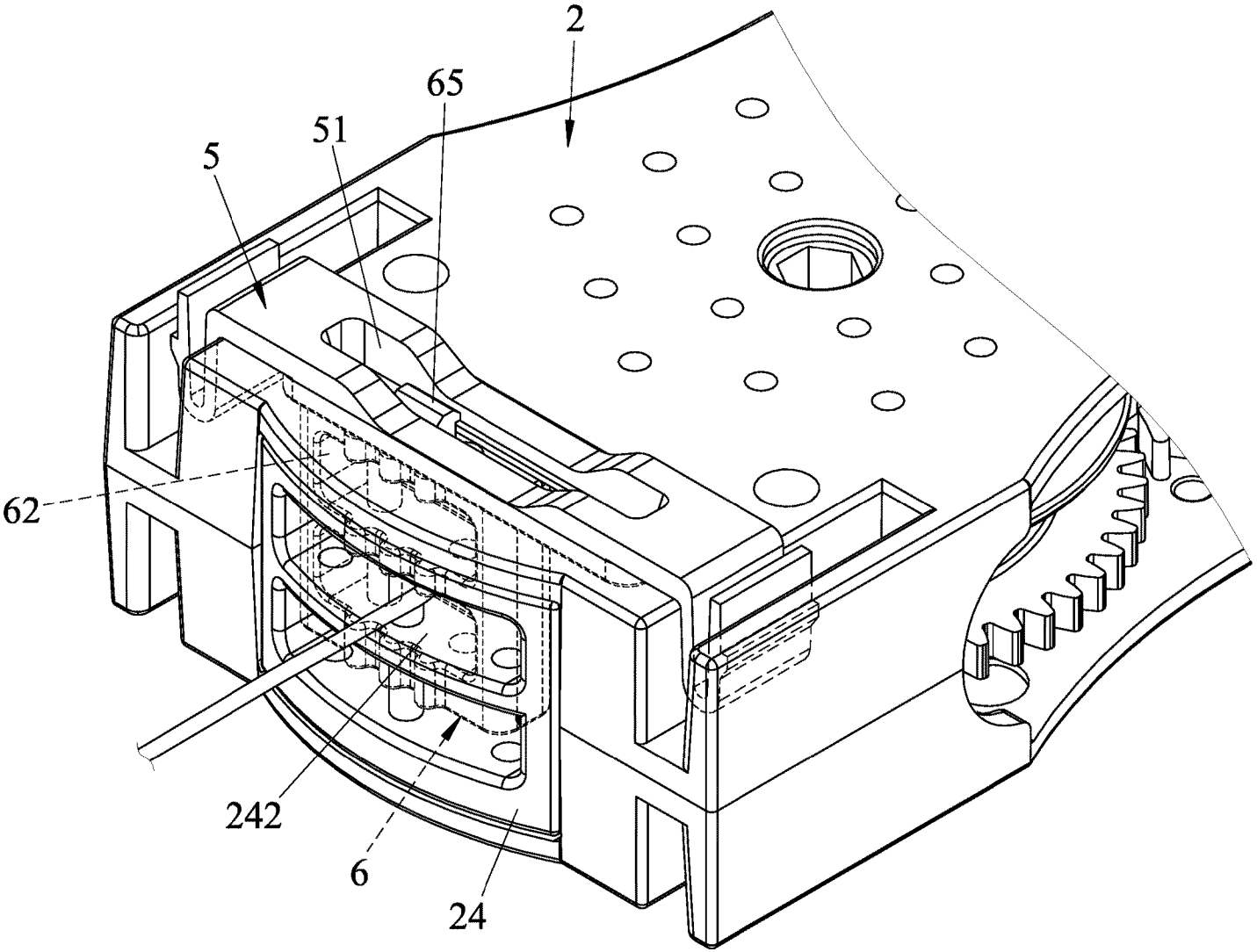
FIG. 7 is a fragmentary perspective view of the embodiment, illustrating the limiting block at the position of maximum resisting force.

Referring to FIGS. 5, 6, and 7, each fixing frame 5 and the respective limiting block 6 may be pulled upward so as to be removed from the casing unit 2. Once removed, the limiting block 6 is changeable in position relative to the inner and outer limiting columns 246, 247 for adjustment of a frictional resisting force against a movement of the respective lift cord 94.

At a position of largest resisting force, as shown in FIG. 5, the limiting block 6 is disposed relative to the side casing body 24 in such a way that the limiting block column 63 is at a maximum distance away from the inner and outer limiting columns 246, 247. When the limiting block 6 is at the position of largest resisting force, the lift cord 94 moving along the cord-exit path (P) bends the largest amount around the limiting block column 63. At this position, the cord-exit path (P) is the most tortuous, and the lift cord 94 experiences a maximum frictional resisting force due to its large contact surface area with the limiting block column 63 and/or the inner and outer limiting columns 246, 247.

At a position of smallest resisting force, as shown in FIG. 6, the limiting block 6 is disposed relative to the side casing body 24 in such a way that the limiting block column 63 is at a minimum distance away from the inner and outer limiting columns 246, 247. When the limiting block 6 is at the position of smallest resisting force, the lift cord 94 moving along the cord-exit path (P) (FIG. 5) of the first cord-exit hole 242 bends the smallest amount around the limiting block column 63 and experiences a minimum frictional resisting force.

By adjusting the limiting block 6 between the position of maximum resisting force and the position of minimum resisting force, the frictional resisting force against a movement of the respective lift cord 94 may be adjusted. The adjustable cord resisting force is incorporated with the restoring force of the scroll spring 32 and the combined weight of the lower beam 92 and the slats 93 of the venetian blind 9 for balancing and keeping the lower beam 92 at any desirable height without needing to apply external force. This adjustment facilitating standardization of the restoring force of the scroll spring 32 and/or other relating components for use with the venetian blind 9 of different dimensions.

Figure 8:
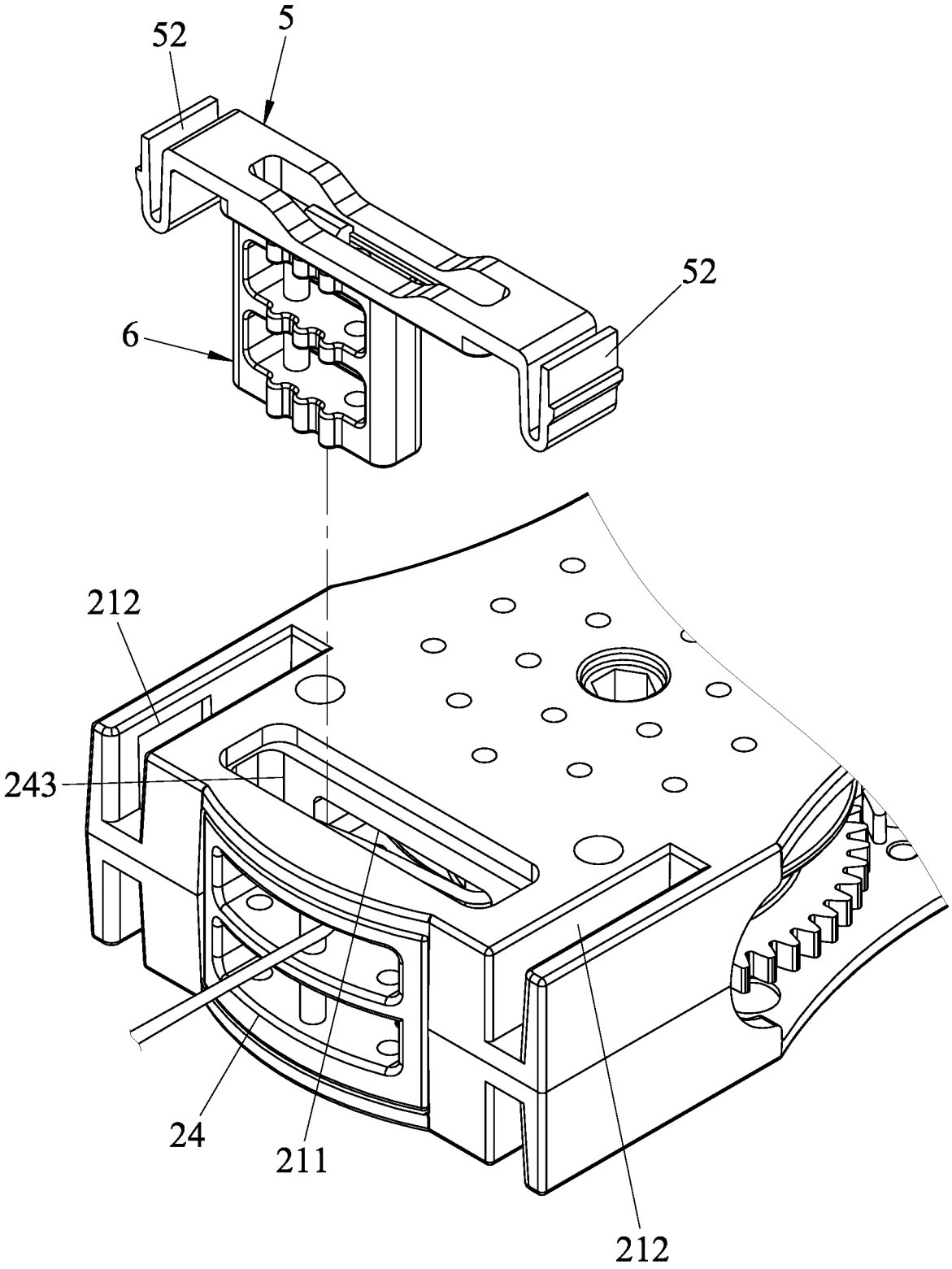
FIG. 8 is a fragmentary perspective view of the embodiment, illustrating the limiting block and a fixing frame of the embodiment being removed for adjusting the position of the limiting block.
Figure 9:
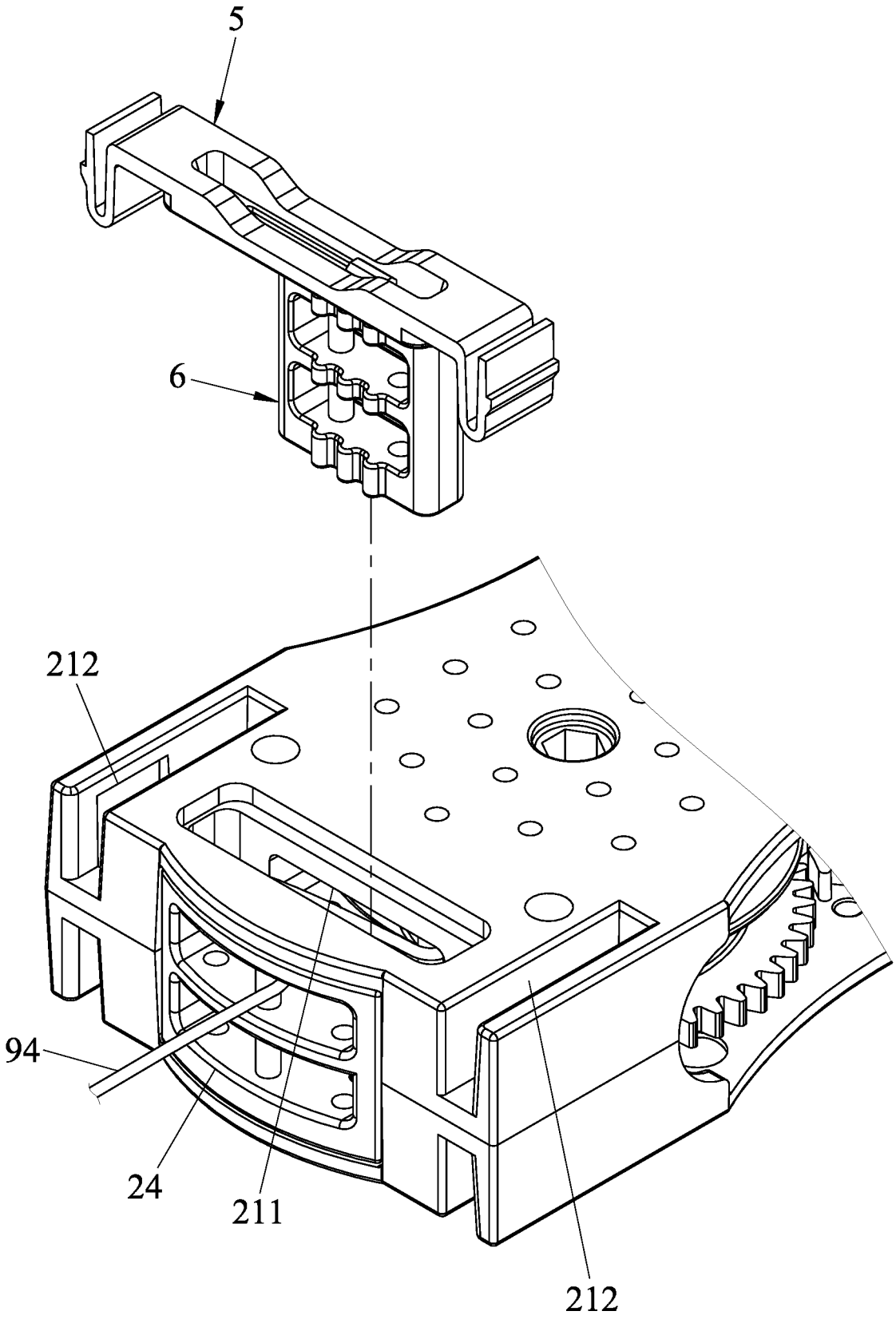
FIG. 9 is similar to FIG. 8 but illustrating the limiting block moved to a different position.
Figure 10:
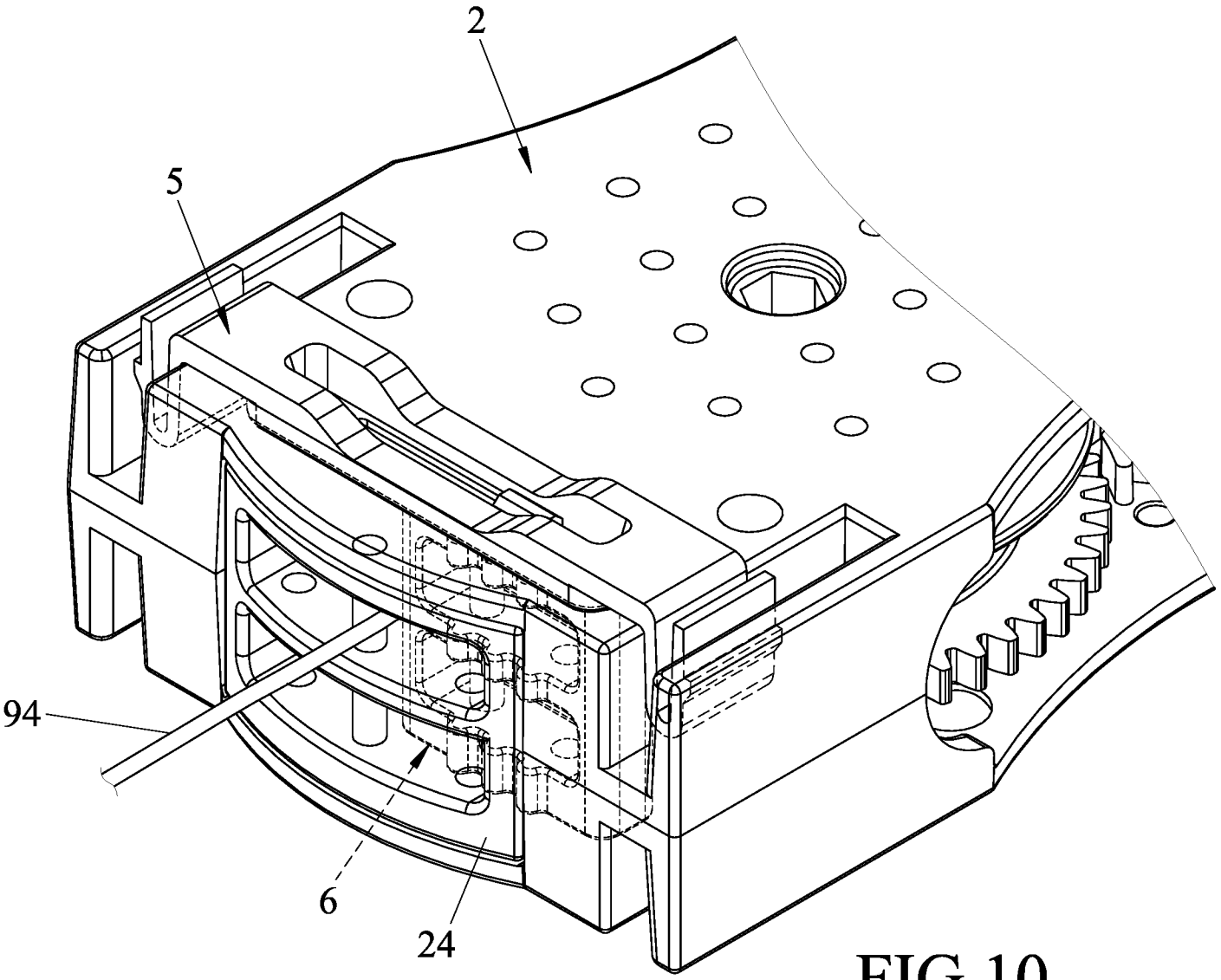
FIG. 10 is similar to FIG. 7 but illustrating the limiting block at the position of minimum resisting force.

As shown in FIGS. 5 and 6, the block teeth portion 64 of the limiting block 6 is adjusted in position by being displaced from one section of the side casing teeth portion 245 to another section of the side casing teeth portion 245. Referring to FIGS. 8, 9 and 10, to adjust the position of the limiting block 6, the engaging portions 52 of the respective fixing frame 5 are first respectively disengaged from the two engaging grooves 212 to allow the limiting block 6 to be removed from the respective upper and side limiting slots 211, 243 along with the respective fixing frame 5. Then, the limiting block 6 may be slid along the sliding slot 51 of the fixing frame 5 to a desired position and then reinserted into the upper and side limiting slots 211, 243 to let the block teeth portion 64 remesh with the casing teeth portion 245.

In sum, by adjusting the position of the limiting blocks 6, the configurations of the cord-exit paths in the first cord-exit holes 242 may be respectively adjusted which changes the frictional resisting forces experienced by the lift cords 94. This allows the frictional resisting forces experienced by the lift cords 94 to be adjusted, which is advantageous for facilitating standardization of the restoring force of the scroll spring 32 and/or other relating components.

In this embodiment, the number of the limiting blocks 6 is two, but in other embodiments, the cord-resistance adjusting device may only include one limiting block 6 in association with one fixing frame 5 and still achieve the same advantage as this embodiment.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A cord-resistance adjusting device adapted for installing on a venetian blind which includes two lift cords, said cord-resistance adjusting device comprising:

a casing unit adapted for mounting to the venetian blind and including an upper casing part, a lower casing part opposite to said upper casing part in a first direction, and two side casing parts spaced-apart in a second direction which is transverse to the first direction and cooperating with said upper and lower casing parts to define a receiving space, each of said side casing parts including a side casing part body, a first cord-exit hole that extends through said side casing part body in the second direction, and that is in spatial communication with said receiving space, and a limiting column set that is mounted to said side casing body inside said first cord-exit hole;

a spring driving unit disposed in said receiving space;

two cord reels rotatably disposed in said receiving space on two opposite sides of said spring driving unit, and meshingly connected with said spring driving unit; and at least one limiting block disposed in at least one of said side casing parts, wherein each of said limiting column sets of said side casing parts includes an inner limiting column proximal to a respective one of said cord reels, and an outer limiting column distal to said one of said cord reels, said inner and outer limiting columns being adapted for a respective one of the lift cords to bend therearound in a frictionally contacting manner, and for said at least one of said side casing parts, said at least one limiting block is movably disposed in said first cord-exit hole between said inner and outer limiting columns such that said first cord-exit hole is provided with a cord-exit path consecutively passing through said inner limiting column, said at least one limiting block and said outer limiting column, whereby the respective lift cord frictionally contacts said at least one limiting block when moving from said inner limiting column to said outer limiting column along said cord-exit path.

2. A cord-resistance adjusting device as claimed in claim 1, wherein said at least one limiting block is changeable in position relative to said inner and outer limiting columns of said at least one of said side casing parts for adjustment of a frictional resisting force against a movement of the respective lift cord.

3. The cord-resistance adjustment device as claimed in claim 1, wherein said at least one limiting block includes two limiting blocks, each of said side casing parts further including a side limiting slot that extends in the first direction through said side casing part body and that is in spatial communication with said first cord-exit hole, said limiting blocks being respectively inserted in the first direction into said slide limiting slots of said side casing parts.

4. The cord-resistance adjusting device as claimed in claim 1, wherein said at least one of said side casing parts further includes a side limiting slot extending in the first direction through said side casing part body in spatial communication with said first cord-exit hole, and disposed between said inner and outer limiting columns, said at least one limiting block being removably inserted into said side limiting slot in the first direction.

5. The cord-resistance adjusting device as claimed in claim 4, wherein said at least one limiting block has a block teeth portion said at least one of said side casing parts including a casing teeth portion that protrude into said side limiting slot to mesh with said block teeth portion, said casing teeth portion having more teeth than said block teeth portion such that said block teeth portion can mesh with said casing teeth portion at different selected sections of said casing teeth portion for adjustment of the position of said block teeth portion relative to said casing teeth portion.

6. The cord-resistance adjusting device as claimed in claim 5, wherein said at least one limiting block further has a block body, a second cord-exit hole extending in the second direction through said block body and in communication with said first cord-exit hole for a corresponding one of the lift cords to exit therethrough, and a limiting block column disposed in said second cord-exit hole along the first direction for the respective lift cord to bend therearound in a frictionally contacting manner.

7. The cord-resistance adjustment device as claimed in claim 6 further comprising a fixing frame coupled with said at least one limiting block, mounted to said upper casing part and removable in the first direction, said fixing frame including a sliding slot that extends in a third direction transverse to both the first and second directions to allow said at least one limiting block to be partially and slidably inserted therein.

8. The cord-resistance adjustment device as claimed in claim 7, wherein said upper casing part has an upper limiting slot corresponding in position to said side limiting slot, said fixing frame partially and engagingly extending into said upper limiting slot and said side limiting slot.

9. The cord-resistance adjustment device as claimed in claim 8, wherein said upper casing part further has two upper engaging grooves disposed on two opposite sides of said upper limiting slot, said fixing frame further having two engaging portions that are disposed on opposite sides of said sliding slot and that respectively engage said upper engaging grooves.

* * * * *